US008042718B2

(12) United States Patent
Taylor et al.

(10) Patent No.: US 8,042,718 B2
(45) Date of Patent: Oct. 25, 2011

(54) FUEL CELL ACTUATION MECHANISM FOR COMBUSTION-POWERED TOOL

(75) Inventors: Walter J. Taylor, McHenry, IL (US); Barry Walthall, Wheeling, IL (US); J. Westley Schwartzenberger, Northlake, IL (US); James A. Purpura, Cary, IL (US)

(73) Assignee: Illinois Tool Works Inc., Glenview, IL (US)

( * ) Notice: Subject to any disclaimer, the term of this patent is extended or adjusted under 35 U.S.C. 154(b) by 182 days.

(21) Appl. No.: 12/553,280

(22) Filed: Sep. 3, 2009

(65) Prior Publication Data

US 2011/0049212 A1 Mar. 3, 2011

(51) Int. Cl.
*B25C 1/08* (2006.01)

(52) U.S. Cl. ..... 227/8; 227/10; 227/130; 123/46 SC

(58) Field of Classification Search ..... 227/8, 9, 227/10, 130, 156; 123/46 SC
See application file for complete search history.

(56) References Cited

U.S. PATENT DOCUMENTS

| | | | | |
|---|---|---|---|---|
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 5,197,646 | A | 3/1993 | Nikolich | |
| 5,263,439 | A | 11/1993 | Doherty et al. | |
| 6,145,724 | A | 11/2000 | Shkolnikov et al. | |
| 6,302,297 | B1 | 10/2001 | Richardson et al. | |
| 6,463,894 | B2 | 10/2002 | Hasler et al. | |
| 6,715,655 | B1 * | 4/2004 | Taylor et al. | 227/8 |
| 6,786,378 | B2 * | 9/2004 | Wagdy et al. | 227/9 |
| 7,296,719 | B1 * | 11/2007 | Taylor et al. | 227/10 |
| 7,341,171 | B2 * | 3/2008 | Moeller et al. | 227/8 |
| 7,478,740 | B2 | 1/2009 | Shea | |
| 7,841,499 | B2 * | 11/2010 | Ho | 227/10 |
| 7,841,500 | B2 * | 11/2010 | Ho | 227/10 |
| 7,918,373 | B2 * | 4/2011 | Ohmori | 227/8 |

FOREIGN PATENT DOCUMENTS

| | | |
|---|---|---|
| EP | 1512496 | 3/2005 |

* cited by examiner

*Primary Examiner* — Scott A. Smith
(74) *Attorney, Agent, or Firm* — Greer, Burns & Crain, Ltd.; Patty Chidiac; Mark W. Croll

(57) ABSTRACT

A combustion nailer includes a tool housing, a combustion source disposed at least partially in the housing and including a valve sleeve reciprocating relative to a cylinder head along a tool axis between a rest position and a pre-firing position, a fuel cell chamber in the housing in operational proximity to the combustion source and dimensioned for accommodating a fuel cell, at least one pivot point associated with the fuel cell chamber transverse to the tool axis for facilitating movement of the fuel cell between a non-activated position and an activated position, and at least one actuator pivotable about the pivot point and engaging the valve sleeve at a point closer to the tool axis than to the fuel cell chamber such that movement of the valve sleeve from the rest position to the pre-firing position causes movement of the fuel cell from the non-activated position to the activated position.

14 Claims, 7 Drawing Sheets

FUEL CELL ACTUATION MECHANISM FOR COMBUSTION-POWERED TOOL

BACKGROUND

The present invention relates generally to handheld power tools, and specifically to combustion-powered fastener-driving tools, also referred to as combustion tools or combustion nailers.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®, BUILDEX® and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Conventional combustion fastener driving tools inherently create a resistance to the user pressing the tool against a workpiece before a fastener is driven. This operation causes a main portion of the tool to depend vertically under user pressure against at least one biasing element relative to a workpiece contact element for causing internal operational steps prior to ignition. Such steps include movement of the valve sleeve toward a cylinder head to close the combustion chamber, and the delivery of a dose of fuel from the fuel cell into the closed combustion chamber. In conventional tools, the resistance of the various internal components and linkages in this operation combine to create a significant actuation force. Conventional combustion nailers have an actuation force in the range of 10-14 pounds. The actuation force is sufficient to contribute to user fatigue after periods of extended tool operation.

BRIEF SUMMARY

The above-listed drawback of conventional combustion tools is met or exceeded by the present tool, featuring an actuation mechanism which reduces the tool actuation force. In the preferred embodiment, an actuator is provided which extends from the fuel cell to the valve sleeve a sufficient distance to create a lever action on the fuel cell to facilitate fuel cell movement to the activation or fuel delivery position. By extending the actuator, the movement of the valve sleeve toward the cylinder head to close the combustion chamber creates a greater mechanical advantage over the fuel cell linkage than conventional combustion nailers. In the preferred embodiment, the actuator is extended at least as far as a main tool longitudinal axis.

More specifically, a combustion nailer includes a tool housing, a combustion source disposed at least partially in the housing and including a valve sleeve reciprocating relative to a cylinder head along a longitudinal tool axis between a rest position and a pre-firing position, a fuel cell chamber defined in the housing in operational proximity to the combustion source and dimensioned for accommodating at least one fuel cell, at least one pivot point associated with the fuel cell chamber and transverse to the tool axis for facilitating movement of the fuel cell between a non-activated position and an activated position, and at least one actuator pivotable about the at least one pivot point and engaging the valve sleeve at a point closer to the tool axis than to the fuel cell chamber such that movement of the valve sleeve from the rest position to the pre-firing position causes movement of the fuel cell from the non-activated position to the activated position.

In another embodiment, a combustion nailer includes a tool housing, a combustion source disposed in the housing and including a valve sleeve reciprocating relative to a cylinder head along a longitudinal tool axis between a rest position and a pre-firing position. A fuel cell chamber is defined in the housing in operational proximity to the combustion source and is dimensioned for accommodating at least one fuel cell. At least one pivot point is associated with the fuel cell chamber and extending transverse to the tool axis for facilitating movement of the fuel cell between a non-activated position and an activated position. At least one actuator is pivotable about the at least one pivot point and extends from the pivot point at least to the tool axis for engaging the valve sleeve.

DETAILED DESCRIPTION

Figure 1:
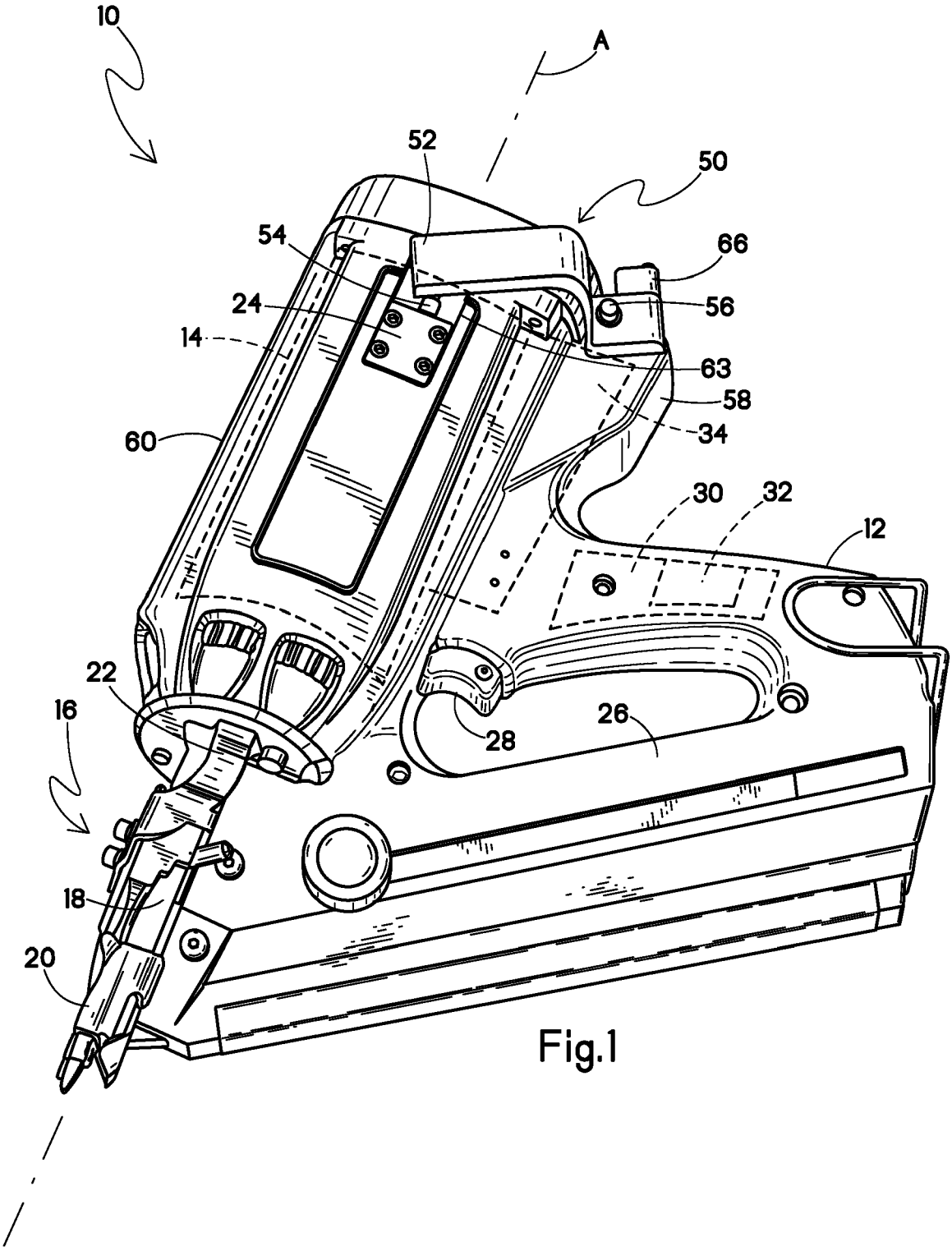
FIG. 1 is a side perspective view of a combustion-powered fastener-driving tool equipped with the present actuation mechanism.

Referring now to FIG. 1, a combustion-powered, fastener-driving tool suitable for incorporating the present handle housing is generally designated 10. While the tool 10 is depicted as being of the type described in the patents listed above, other types of fastener-driving tools are contemplated as having the potential of incorporation of the present handle housing. Also, the tool 10 is depicted as a framing tool, however so-called trim tools are also considered suitable for use with the present actuation mechanism. The tool 10 includes a main housing 12, usually made of injection molded plastic. A power source 14 (preferably a combustion-powered power source as is known in the art and shown hidden) is at least partially enclosed within the housing 12, which may be provided in one or more components, as is known in the art.

Other major components of the tool are the nosepiece assembly 16, including a nosepiece 18 typically secured to the power source and configured for receiving a driver blade connected to a piston reciprocating within the power source. A workpiece contact element 20 actually contacts the workpiece and is linked via an upper probe 22 to a valve sleeve 24 which forms part of a combustion chamber (not shown) and periodically opens to allow purging and recharge of fuel and combustion gases as is known in the art. In the art, the valve sleeve 24 reciprocates along a main tool axis 'A' between a rest position (FIG. 2) and a pre-firing position (FIG. 3). The nosepiece 18 also receives fasteners fed by a magazine 26, providing a supply of fasteners and configured for feeding the fasteners to the nosepiece.

Figure 8:
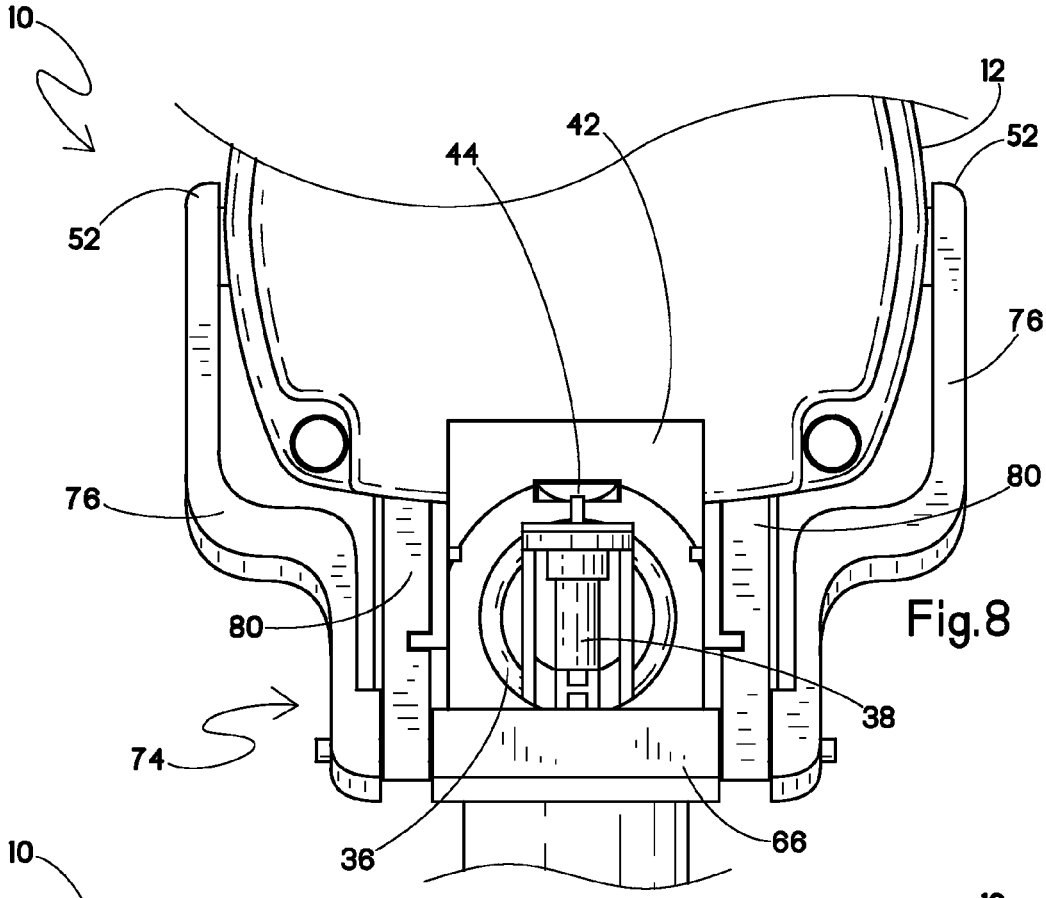
FIG. 8 is a fragmentary top plan view of the tool of FIG. 7.

Referring now to FIGS. 1-7, a trigger 28 is employed by the user to initiate the operation of the power source 14 for driving fasteners. Operation of the trigger 28 and other tool functions is controlled by a control unit 30 (shown hidden), typically including a microprocessor equipped with a control program 32 (shown hidden). Adjacent the power source 14 is a fuel cell chamber 34 (best seen in FIGS. 4 and 5) enclosing and accommodating at least one fuel cell 36 having a metering valve 38 (FIG. 8). While the metering valve 38 illustrated is of the "on-can" type disclosed in U.S. Pat. No. 6,302,297 incorporated by reference, it is also contemplated that the present tool accommodates fuel cells having "in-can" valves as disclosed in U.S. Pat. No. 7,392,922 also incorporated by reference.

Figure 11:
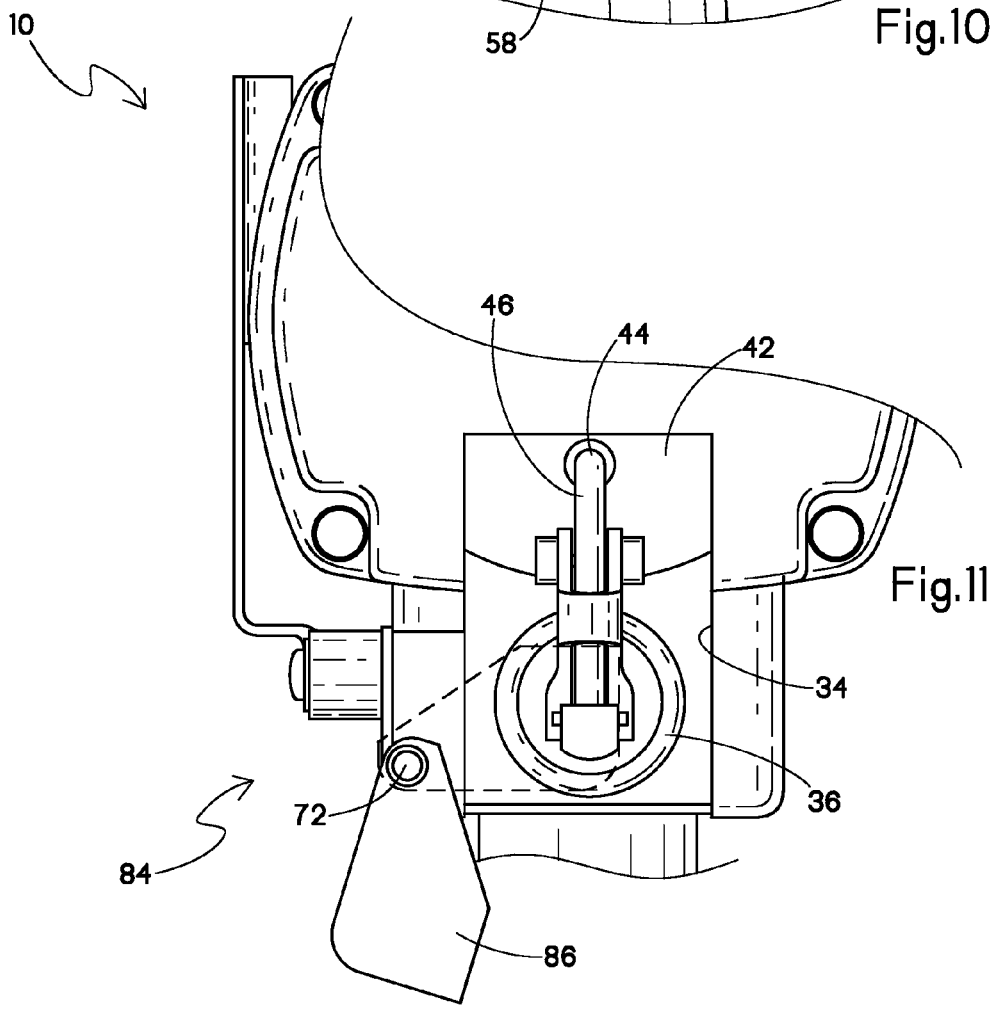
FIG. 11 is a fragmentary top plan view of a second alternate embodiment of the present tool showing the fuel cell release mechanism.

In conventional combustion nailers, the movement of the valve sleeve 24 activates a linkage (not shown), which causes depression of a valve stem 40 (FIG. 4) on the fuel cell 36, which activates an internal dosing apparatus to deliver a dose of fuel from the fuel cell to the combustion chamber. More specifically, the fuel is delivered to a cylinder head 42 defining an upper portion of the combustion chamber and having a fuel intake fitting 44 (FIG. 8) receiving fuel from the metering valve 38. The metering valve 38 is either directly connected to the fuel intake fitting 44 (FIG. 8), or indirectly, using a flexible fuel conduit 46 (FIG. 11). In conventional combustion nailers, a desired fuel dose for a single combustion is obtained by the linkage causing the fuel cell 36 to rock towards the cylinder head 42, or alternately causes the valve stem 40 to depress axially, as disclosed in commonly assigned U.S. Pat. No. 7,478,740 incorporated by reference. In some cases, a fuel cell door (not shown) is part of the linkage used to obtain a fuel dose.

As described above, it has been found that one source of user fatigue in operating conventional combustion nailers is the amount of force needed to press the tool against the workpiece. This pressing action causes the cylinder head 42 to move towards the valve sleeve 24, thus closing the combustion chamber. The same movement causes a dose of fuel to be injected into the combustion chamber as described above. A sum of the various linkages and sources of friction results in a total resistance, hereinafter referred to as an activation force, in conventional tools being in the range of 10-14 pounds.

Referring now to FIGS. 1-5, a feature of the present tool is that the above-described activation force is reduced by modifying the linkage that connects the valve sleeve 24 with the fuel cell 36. An actuator, generally designated 50, also referred to as a dosing arm, extends from the fuel cell chamber 34 to a point adjacent the valve sleeve 24. Preferably, a free end 52 of the actuator 50 engages the valve sleeve 24 at least at a point 54 adjacent the main tool axis 'A', and transfers the motion of the valve sleeve to the fuel cell 36 through at least one pivot point 56, preferably a pivot axis extending transverse to the main tool axis 'A.' The pivot point 56 is located on the housing 12 at a point near a junction of the fuel cell chamber 34 with the power source 14.

In the preferred embodiment, the point 54 is located closer to the tool axis 'A' than to the fuel cell chamber 34, such that movement of the valve sleeve 24 from the rest position to the pre-firing position causes movement of the fuel cell 36 from a non-activated position in which no fuel is dispensed, to an activated position, in which the valve stem 40 is depressed and fuel is injected to the combustion chamber. It is most preferred, so that the actuator 50 exerts sufficient leverage about the pivot axis 56, that the point 54 is located at least along the axis 'A' or on the opposite side of axis 'A' than the fuel cell chamber 34. In other words, assuming the tool 10 is characterized has having a rear 58 and a front 60, the actuator 50 engages the valve sleeve 24 closer to the front than to the rear.

Figure 2:
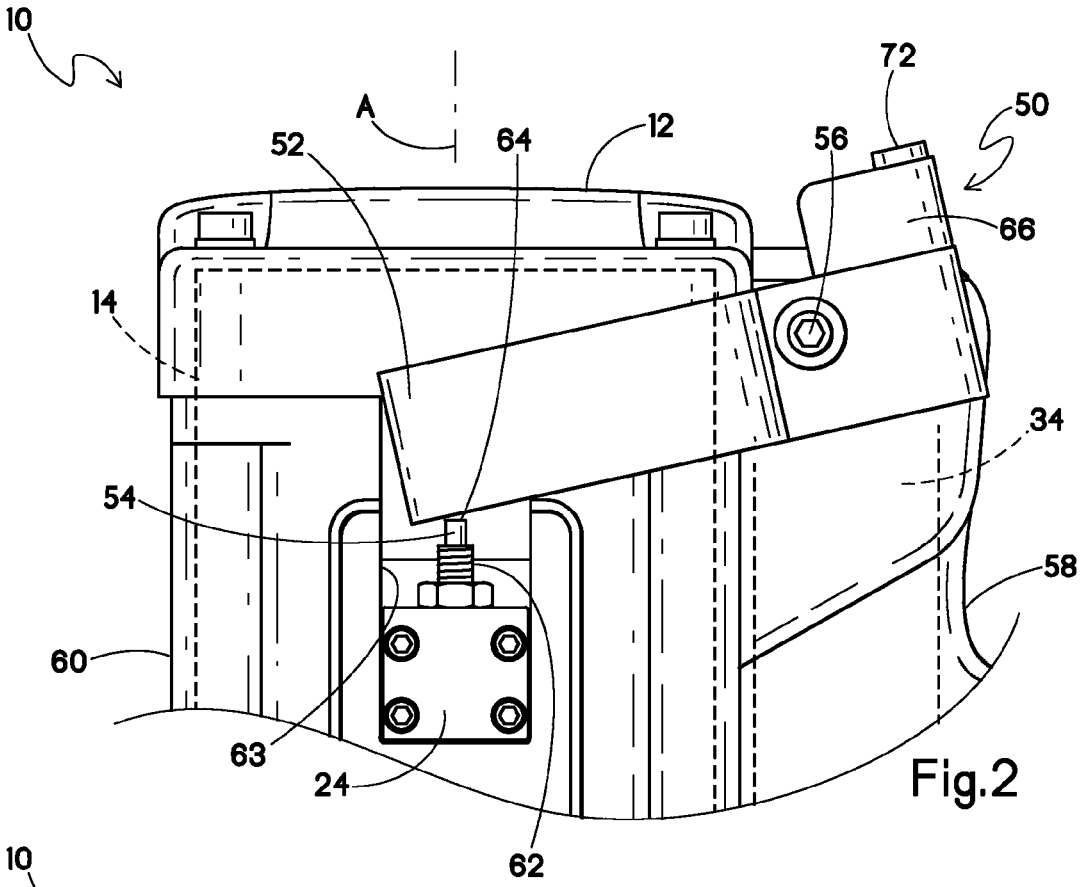
FIG. 2 is a fragmentary side elevation of the tool of FIG. 1 in a rest position.
Figure 3:
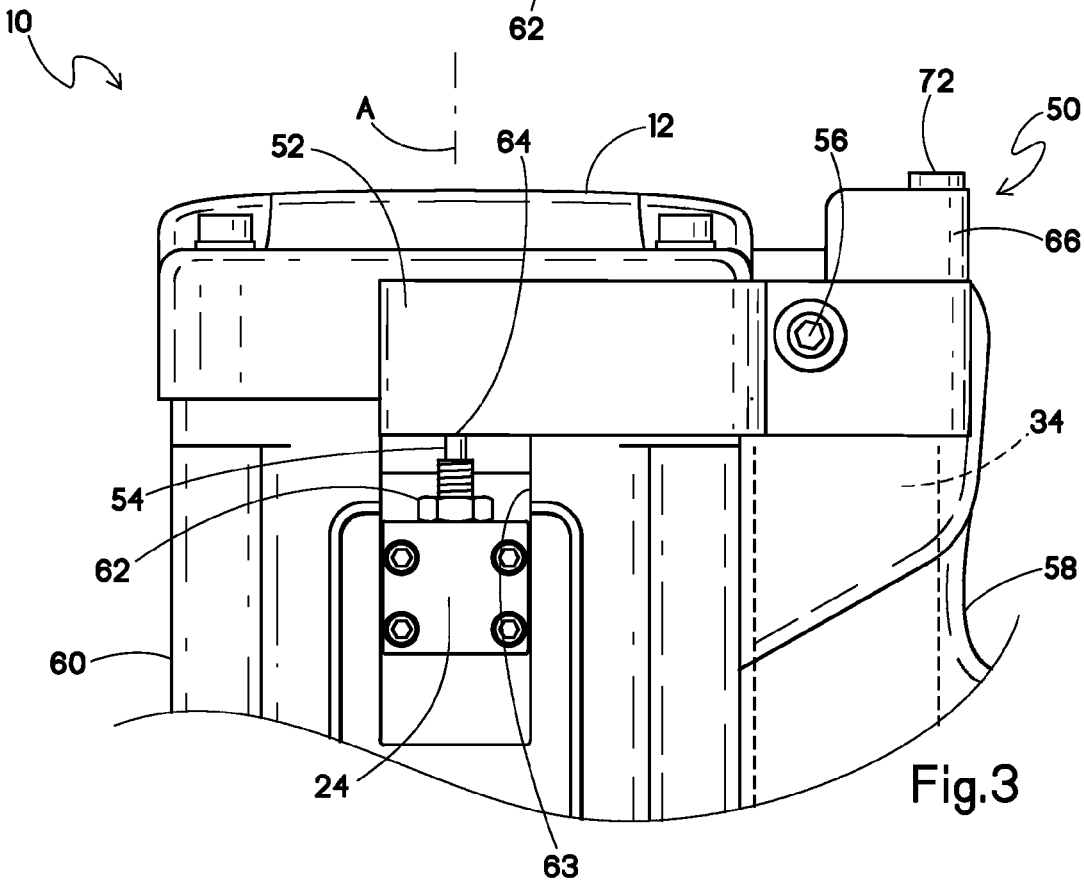
FIG. 3 is a fragmentary side elevation of the tool of FIG. 2 shown in an actuated position.

Referring now to FIGS. 2 and 3, to accommodate variations in manufacturing tolerances of the tool 10, it is also preferred that a biased over travel member 62 is mounted on the valve sleeve 24 to be engaged by the free end 52 of the actuator 50. In the depicted embodiment, a plurality of fasteners are employed for attaching the over travel member 62; however other equivalent fastening technologies are contemplated. It is preferred that the over travel member 62 includes a spring-loaded or biased ball cam type plunger 64 or the like which accommodates in the range of 2-3 pounds of force once the actuator 50 has caused the fuel cell 36 to dispense a dose of fuel for a combustion event as is known in the art. The over travel member 62 accommodates variations in tool manufacture that may allow additional downward movement of the tool relative to the workplace contact element 20 after the dose of fuel has been dispensed. It is contemplated that other conventional over travel compensators may be employed besides the plunger 64. Also, the housing 12 is provided with a slot 63 which accommodates coordinated movement of the over travel member 62 with the valve sleeve 24.

Referring now to FIGS. 2-5, opposite the free end 52, the actuator 50 is provided with a fuel cell engager 66 which is constructed and arranged for manipulating an upper end of the fuel cell 36 as the actuator is pivoted. This pivoting occurs simultaneously with the pressing of the tool 10 against the workpiece. Through this movement, the engager 66 engaging the fuel cell 36 for movement toward an activated position where fuel is dispensed.

Figure 4:
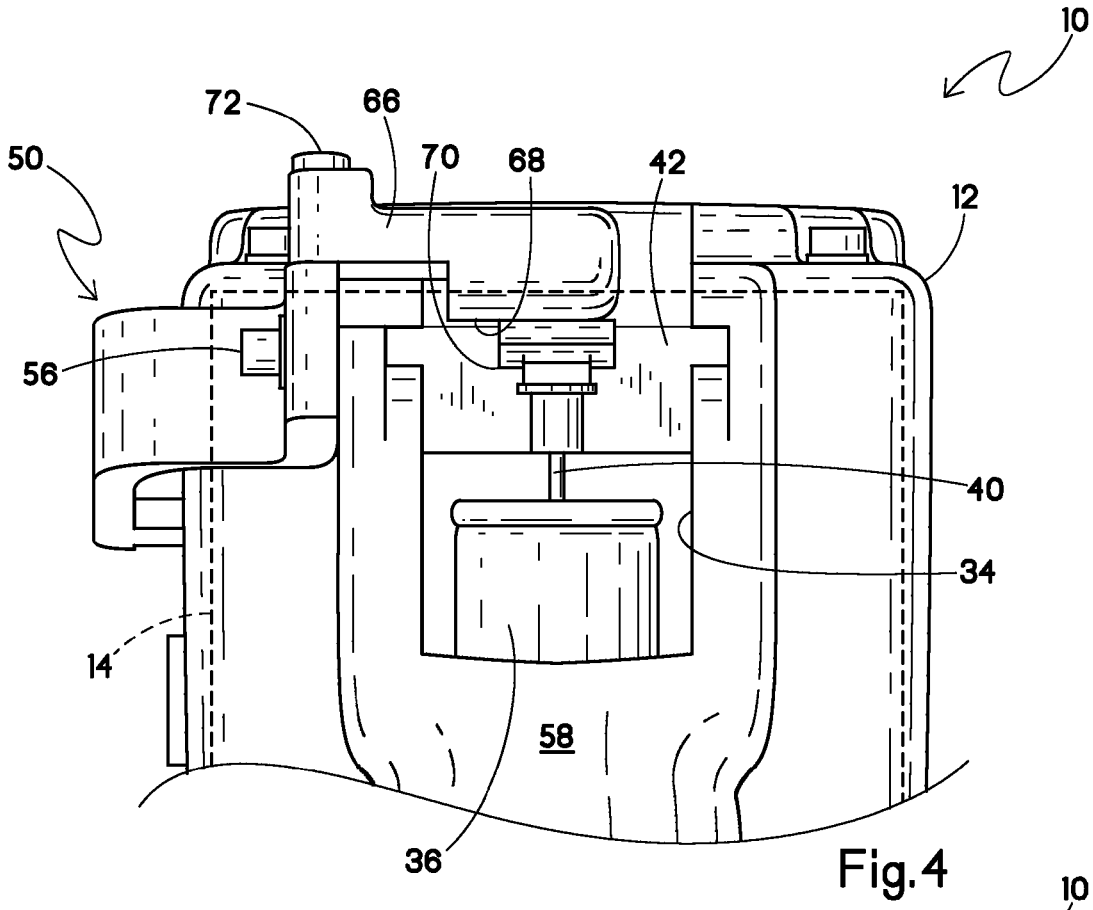
FIG. 4 is a fragmentary rear elevation of the tool of FIG. 2.
Figure 5:
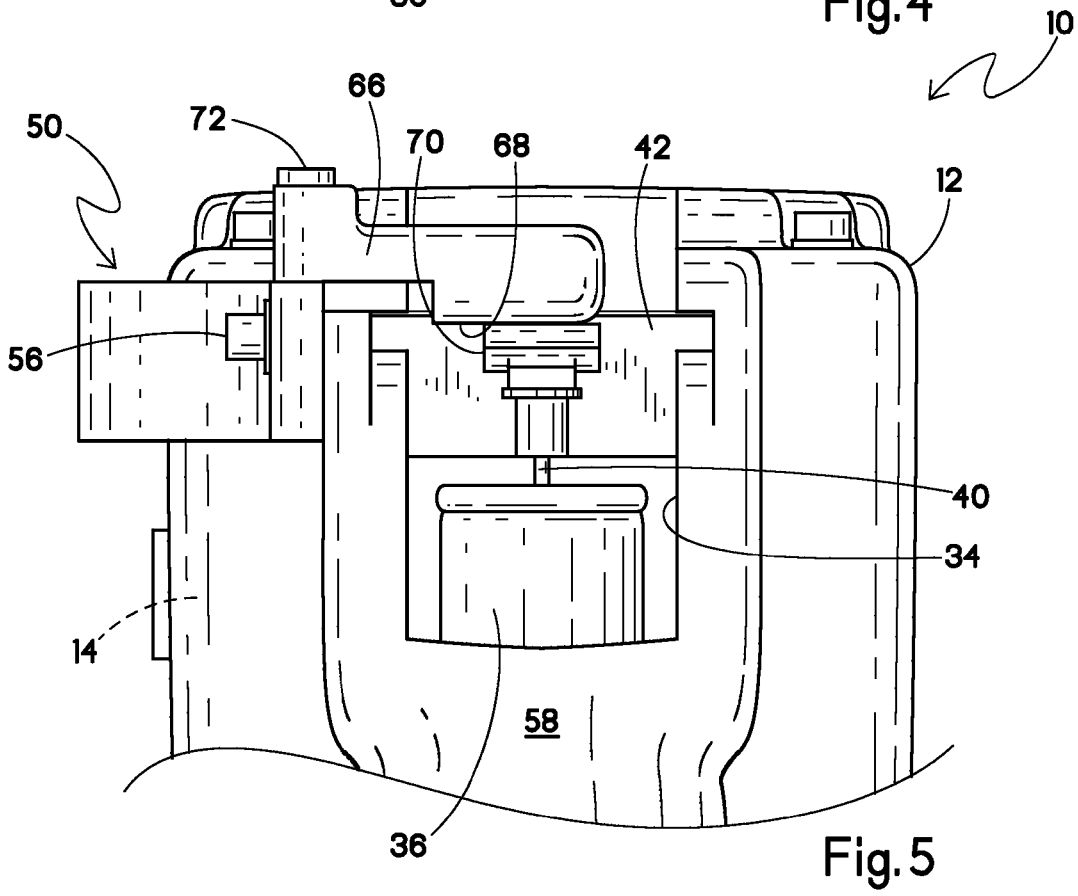
FIG. 5 is a fragmentary rear elevation of the tool of FIG. 3.

Depending on the type of fuel cell 36, the motion caused by the engager 66 will either exert an axial depressing force or a forward rocking motion to dispense the fuel. In FIGS. 4 and 5, the engager 66 exerts an axial force on the fuel cell valve stem 40 as the actuator 50 is pivoted by its engagement with the valve sleeve 24. While other configurations are contemplated, the fuel cell engager 66 is a block-like member having an engaging surface 68 configured for engaging the corresponding metering valve 38 or other stem actuator 70 depending on the type of fuel cell 36 used in the tool 10 and translating the pivoting motion of the actuator 50 into an appropriate actuating force. In FIGS. 4 and 5, the fuel cell 36 is the In-can type, and the stem actuator 70 is preferably of the type disclosed in U.S. Pat. No. 7,478,740, incorporated by reference. Basically, a vertical depressing force on the actuator 70 causes the stem 40 to retract, dispensing a measured dose of fuel into the actuator. The fuel is then transmitted to the combustion chamber through the cylinder head 42.

Figure 6:
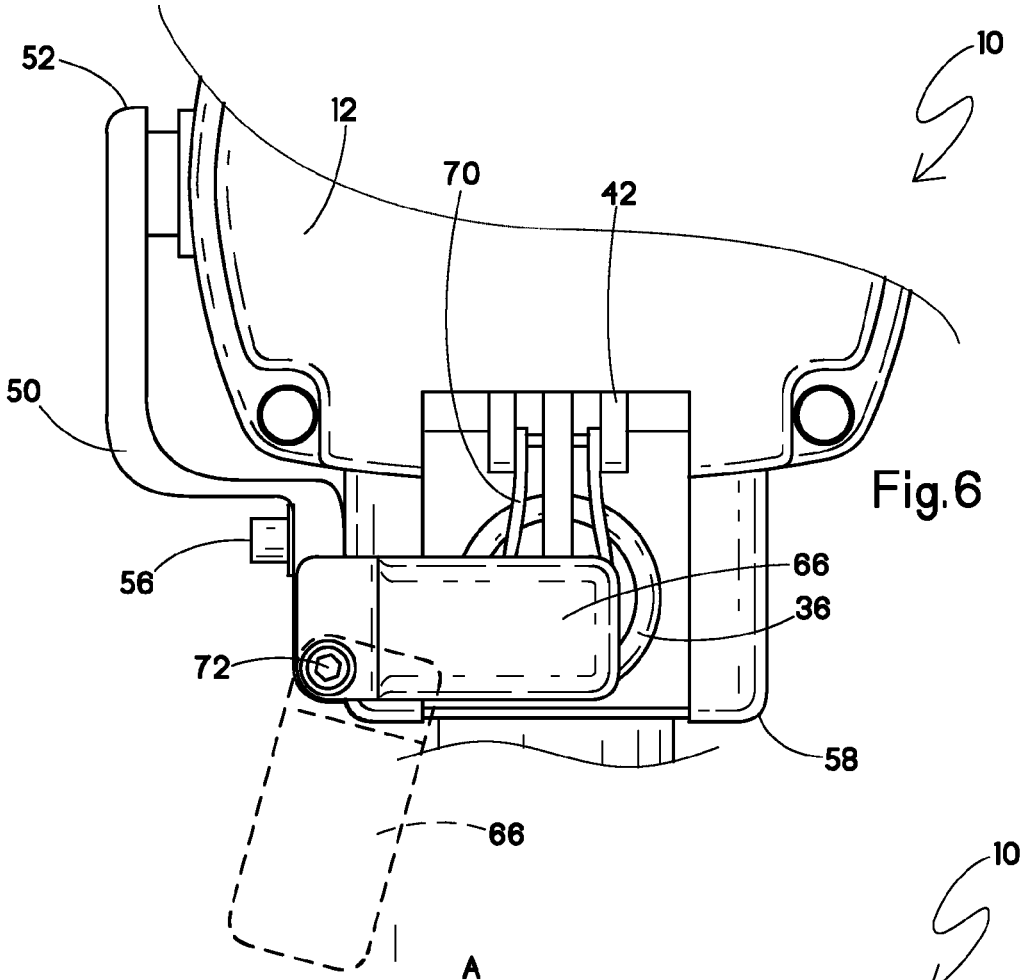
FIG. 6 is a fragmentary top plan view of the tool of FIGS. 2 and 4.
Figure 7:
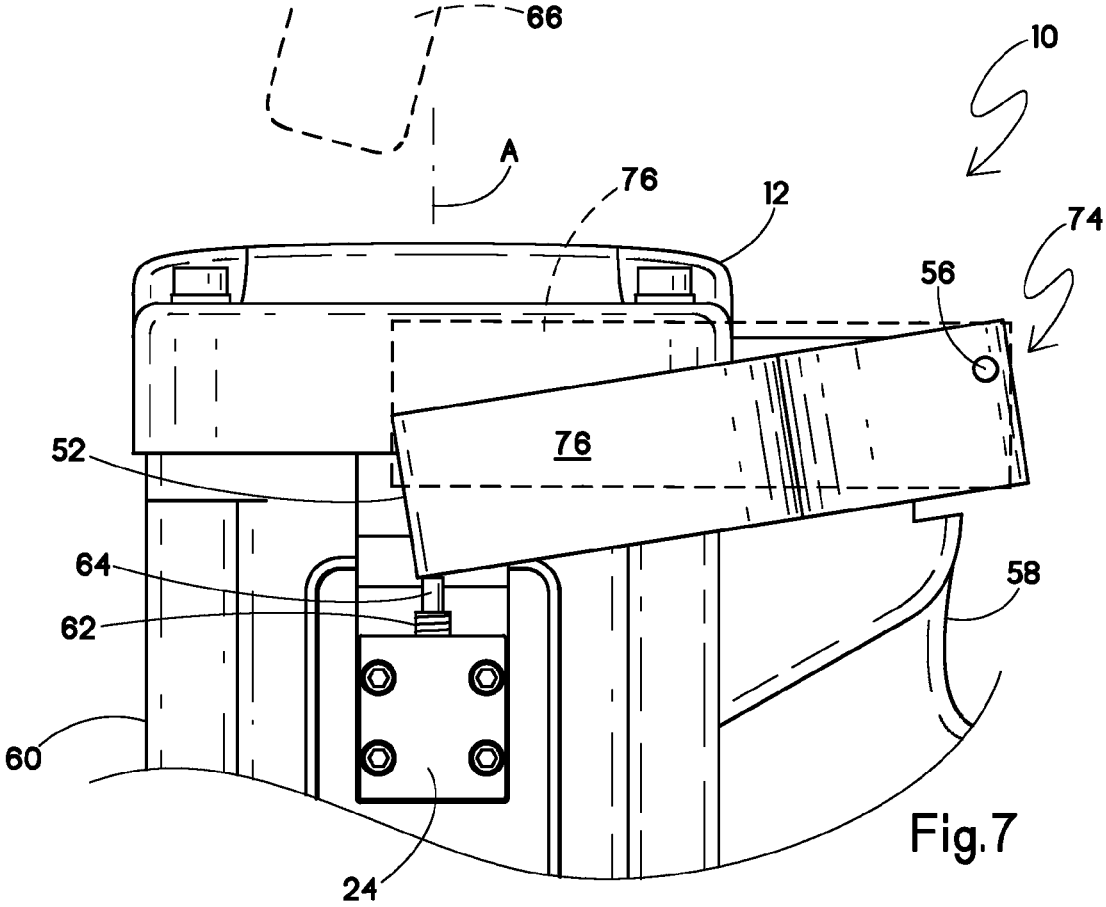
FIG. 7 is a fragmentary side elevation of an alternate embodiment of the tool of FIG. 2 shown in a rest position.

Referring now to FIG. 6, it is also preferred that the fuel cell engager 66 is movable about a vertical pivot axis 72, taking the form of a bolt in the depicted embodiment. In the preferred embodiment, the axis 72 is parallel to the tool axis 'A'. The engager 66 is shown in solid lines in an operational position, with a pivoted fuel cell replacement or exchange position shown in phantom. With the actuator 50, it has been found that a mechanical advantage is achieved in the range of 5:1-6:1 relative to the at least one pivot axis 56. In the tool 10 equipped with the actuator 50, the actuation force was reduced to approximately 6-7 pounds of force to depress the tool against the workpiece prior to firing, compared to approximately 14 pounds for a standard tool.

Referring now to FIGS. 7-10, an alternate embodiment of the actuator is generally designated 74. Shared components with the actuator 50 are designated with identical reference numbers. The actuator 74 operates similarly to the actuator 50 in relation to its engagement with the valve sleeve 24 through the over travel member 62. However, the actuator 74 is provided with a pair of actuator arms 76, instead of the single arm of the actuator 50. Each arm 76 is associated with a corresponding side of the tool housing 12, and is connected at the pivot axis 56 for common movement with the fuel cell engager 66, here configured for exerting a forward pushing movement upon actuation, typically for use with the so called On-can fuel cell metering valve 38. The free ends 52 of each arm 76 are associated with a corresponding point on the valve sleeve 24, preferably provided with an over travel member 62.

Figure 9:
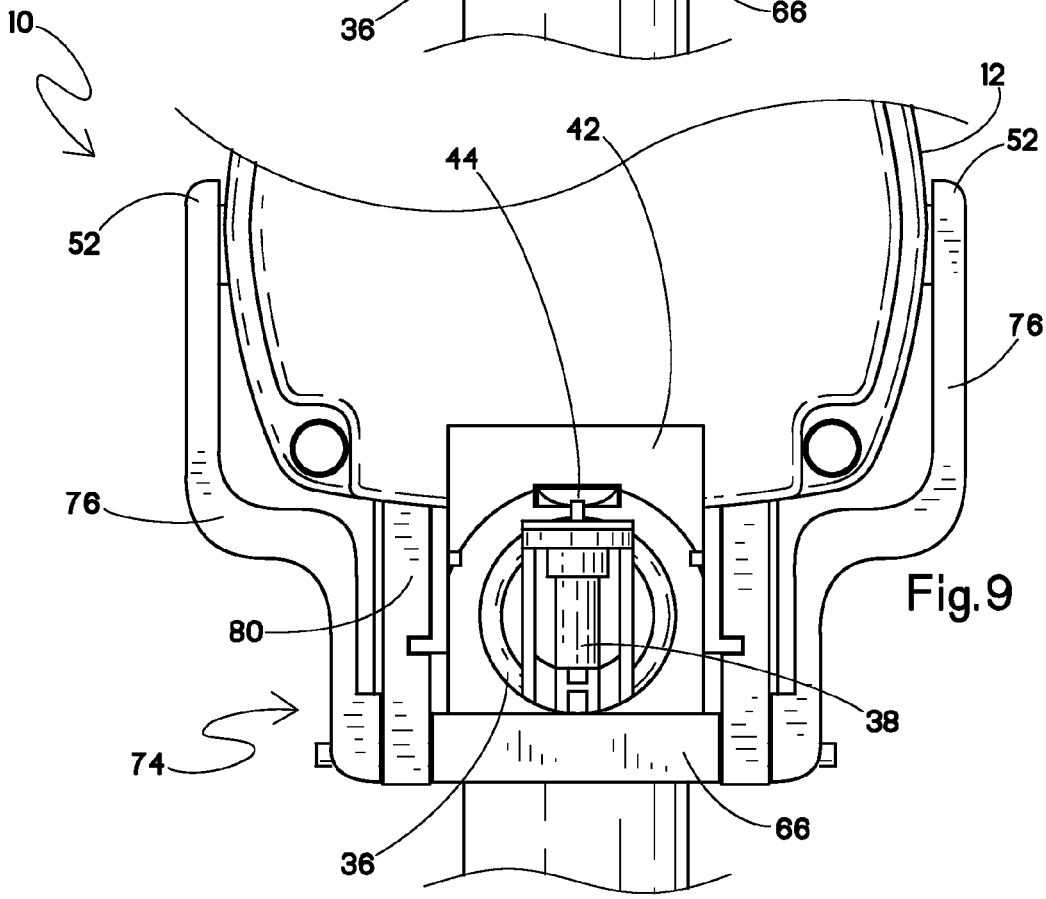
FIG. 9 is a fragmentary top plan view of the tool of FIG. 8 shown in an actuated position.
Figure 10:
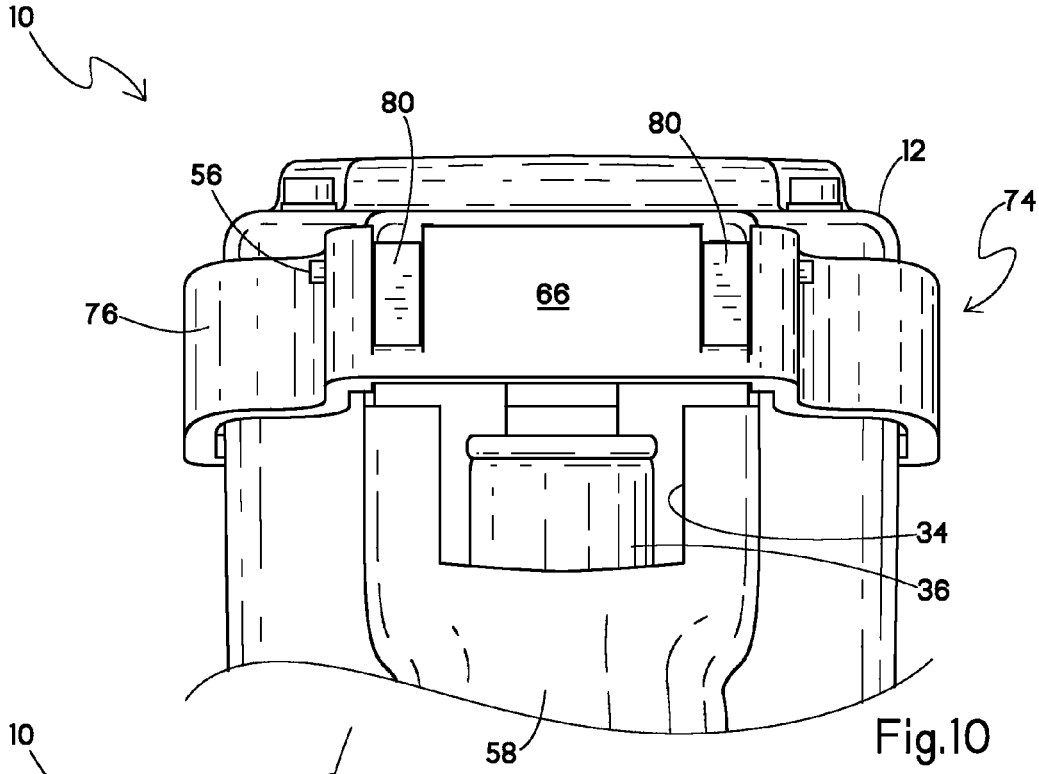
FIG. 10 is a fragmentary rear elevation of the tool of FIG. 9.

The actuator 74 is secured to the tool 10 at a pair of generally spaced, parallel extensions 80 projecting rearwardly from the cylinder head 82, with the engager 66 located between the extensions. As seen in FIG. 10, the actuator 74 is unitary, with the arms 76 and the engager 66 formed as a single piece, and the assembly forms a general "U"-shape when viewed from above (FIGS. 8 and 9).

Figure 12:
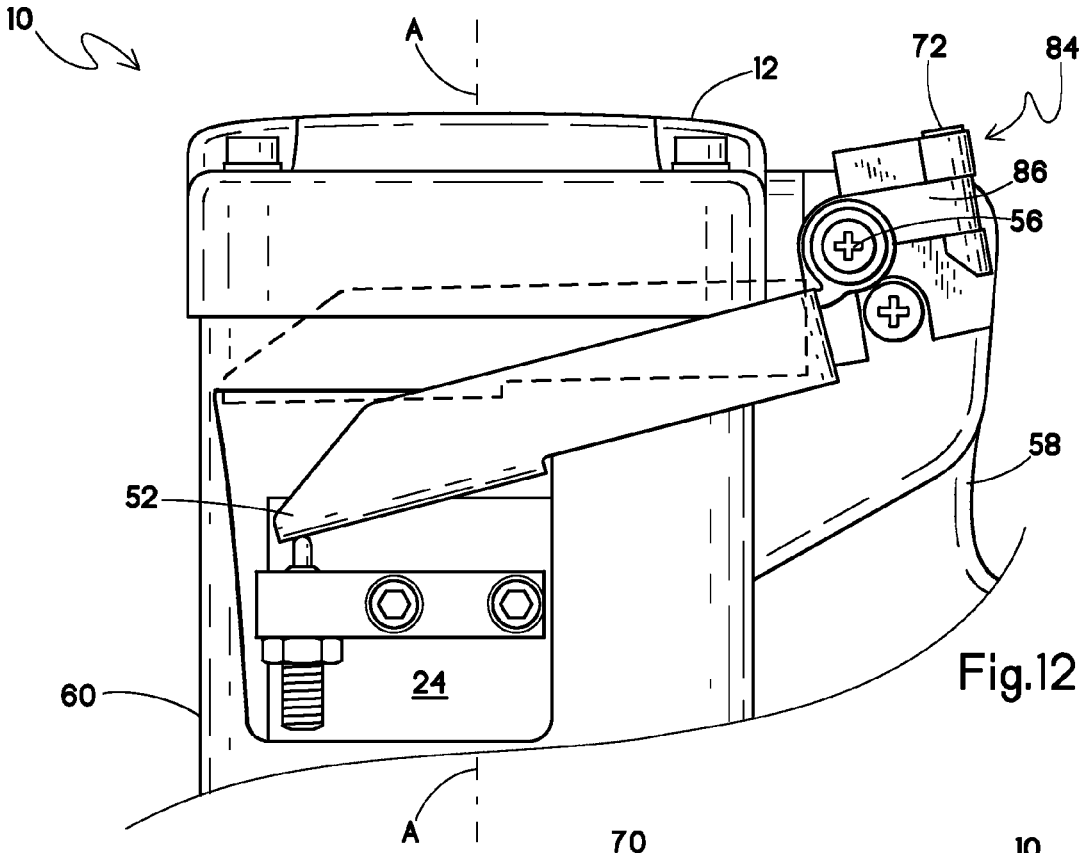
FIG. 12 is a fragmentary side elevation of the tool of FIG. 11 shown in a rest position.
Figure 13:
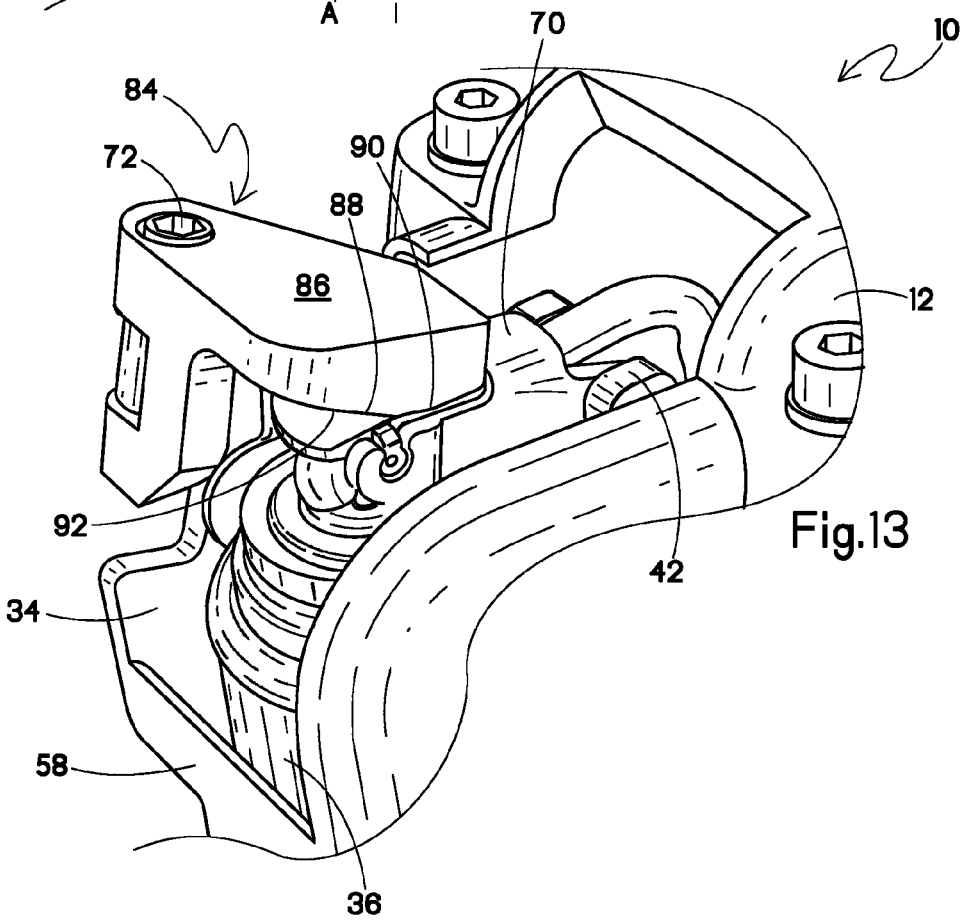
FIG. 13 is a fragmentary top perspective view of the tool of FIG. 12.

Referring now to FIGS. 11-13, another alternate embodiment of the present actuator is generally designated 84. As is the case with the actuators 50 and 74, corresponding components are designated with identical reference numbers. One distinctive feature of the actuator 84 is that the free end 52 contacts the over travel member 62 past the tool axis 'A' relative to the fuel cell chamber 34. In other words, the over travel member 62 is mounted on the valve sleeve 24 closer to the front 60 of the tool 10 than to the rear 58.

Another feature of the actuator 84 is an engager 86 that is similar to the engager 66 of the actuator 50 and pivots about the axis 72. The engager 86 is provided with a multi-faceted fuel cell engagement surface 88 for facilitating movement of the fuel cell 36 from the non-activated to the activated position. A first surface facet 90 is generally horizontal, and engages the fuel cell 36 in a rest position. A second surface facet 92 is angled obliquely relative to the first surface facet 90 and, engages the fuel cell 36 is a pre-firing position. Upon pivoting action of the actuator 84, the surface facet 92 exerts a generally forward thrusting action on the fuel cell 36.

It will be seen that regardless of whether the actuator 50, 74, 84 is employed, there is a reduced actuation force for the operator when driving fasteners with the tool 10. Thus, user fatigue is reduced, particularly after extended tool use.

While particular embodiments of the present fuel cell actuation mechanism for a combustion-powered tool have been described herein, it will be appreciated by those skilled in the art that changes and modifications may be made thereto without departing from the invention in its broader aspects and as set forth in the following claims.

The invention claimed is:

1. A combustion nailer, comprising:

a tool housing;

a combustion source disposed at least partially in said housing and including a valve sleeve reciprocating relative to a cylinder head along a longitudinal tool axis between a rest position and a pre-firing position;

a fuel cell chamber defined in said housing in operational proximity to said combustion source and dimensioned for accommodating at least one fuel cell;

a pivot axis associated with said fuel cell chamber and extending transverse to said tool axis; and at least one actuator pivotable about said at least one pivot point and engaging said valve sleeve at a point closer to said tool axis than to said fuel cell chamber such that movement of said valve sleeve from said rest position to said pre-firing position causes movement of the fuel cell from the non-activated position to the activated position.

2. The tool of claim 1 wherein said tool has a rear and a front, and said at least one actuator engages said valve sleeve closer to said front than to said rear.

3. The tool of claim 1 wherein said valve sleeve includes a biased over travel member for accommodating tolerance variations.

4. The tool of claim 3 wherein said over travel member is a ball cam plunger.

5. The tool of claim 1 wherein said actuator includes a fuel cell engager located on an opposite side of said at least one pivot point for engaging the fuel cell for movement toward the activated position.

6. The tool of claim 5 wherein said fuel cell engager is movable between an operational position and a fuel cell replacement position.

7. The tool of claim 6 wherein said fuel cell engager is pivotable about an axis parallel to said tool axis.

8. The tool of claim 5 wherein said fuel cell engager is provided with a multi-faceted fuel cell engagement surface for facilitating movement of the fuel cell from the non-activated to the activated position.

9. The tool of claim 8 wherein said fuel engagement surface includes a first surface for engaging the fuel cell in said rest position, and a second surface inclined at an angle relative to said first surface for engaging the fuel cell in said pre-firing position.

10. The tool of claim 1 wherein said at least one actuator includes a pair of actuators, each located on a corresponding side of said tool and both being connected to an associated one of said at least one pivot point.

11. The tool of claim 10, wherein said pair of actuators and a fuel cell engager are unitarily formed.

12. The tool of claim 11, wherein said actuators and said engager form a general "U"-shape when viewed from above.

13. The tool of claim 1, wherein said actuator provides a mechanical advantage in the range of 5:1 relative to said at least one pivot point.

14. A combustion nailer, comprising:

a tool housing;

a combustion source disposed in said housing and including a valve sleeve reciprocating relative to a cylinder head along a longitudinal tool axis between a rest position and a pre-firing position;

a fuel cell chamber defined in said housing in operational proximity to said combustion source and dimensioned for accommodating at least one fuel cell;

at least one pivot point associated with said fuel cell chamber transverse to said tool axis for facilitating movement of the fuel cell between a non-activated position and an activated position; and at least one actuator pivotable about said at least one pivot point and extending from said pivot point at least to said tool axis for engaging said valve sleeve.

* * * * *